US010457883B2

(12) United States Patent
Yoon

(10) Patent No.: US 10,457,883 B2
(45) Date of Patent: Oct. 29, 2019

(54) METHOD OF SEPARATING AND DE-WATERING FINE PARTICLES

(71) Applicant: Virginia Tech Intellectual Properties, Inc., Blacksburg, VA (US)

(72) Inventor: Roe-Hoan Yoon, Blacksburg, VA (US)

(73) Assignee: Virginia Tech Intellectual Properties, Inc., Blacksburg, VA (US)

( * ) Notice: Subject to any disclaimer, the term of this patent is extended or adjusted under 35 U.S.C. 154(b) by 0 days.

(21) Appl. No.: 15/294,377

(22) Filed: Oct. 14, 2016

(65) Prior Publication Data

US 2017/0101597 A1 Apr. 13, 2017

Related U.S. Application Data

(63) Continuation of application No. 13/915,428, filed on Jun. 11, 2013, now Pat. No. 9,518,241, which is a continuation-in-part of application No. 13/576,067, filed as application No. PCT/US2011/023161 on Jan. 31, 2011, now Pat. No. 9,789,492.

(60) Provisional application No. 61/658,153, filed on Jun. 11, 2012, provisional application No. 61/300,270, filed on Feb. 1, 2010.

(51) Int. Cl.

| | |
|---|---|
| ***C10L 9/10*** | (2006.01) |
| ***C10L 9/02*** | (2006.01) |
| ***B03B 9/00*** | (2006.01) |
| ***B03B 1/04*** | (2006.01) |

(52) U.S. Cl.

CPC *C10L 9/10* (2013.01); *B03B 1/04* (2013.01); *B03B 9/00* (2013.01); *B03B 9/005* (2013.01); *C10L 9/02* (2013.01); *C10L 2290/24* (2013.01); *C10L 2290/34* (2013.01)

(58) Field of Classification Search

CPC .. B03B 1/04; B03B 9/005; B03B 9/00; B03B 9/02; C10L 2290/24; C10L 2290/34; C10L 9/02; C10L 9/10

See application file for complete search history.

(56) References Cited

U.S. PATENT DOCUMENTS

| | | | |
|---|---|---|---|
| 4,169,714 | A | 10/1979 | Calvert |
| 4,209,301 | A | 6/1980 | Nicol et al. |
| 4,244,699 | A | 1/1981 | Smith et al. |

(Continued)

FOREIGN PATENT DOCUMENTS

| | | |
|---|---|---|
| CA | 1198704 A1 | 12/1985 |
| CL | 47956 | 10/2011 |

(Continued)

OTHER PUBLICATIONS

Chilean Office Action dated Feb. 9, 2016 in connection with related Chilean Patent Application No. 3345-14.

(Continued)

*Primary Examiner* — Latosha Hines

(74) *Attorney, Agent, or Firm* — Grossman, Tucker, Perrault & Pfleger, PLLC

(57) ABSTRACT

A process for cleaning and dewatering hydrophobic particulate materials is presented. The process is performed in in two steps: 1) agglomeration of the hydrophobic particles in a first hydrophobic liquid/aqueous mixture; followed by 2) dispersion of the agglomerates in a second hydrophobic liquid to release the water trapped within the agglomerates along with the entrained hydrophilic particles.

3 Claims, 2 Drawing Sheets

(56) References Cited

U.S. PATENT DOCUMENTS

| | | | | |
|---|---|---|---|---|
| 4,248,698 | A | 2/1981 | Keller, Jr. | |
| 4,484,928 | A | 11/1984 | Keller, Jr. | |
| 4,613,429 | A | 9/1986 | Chiang et al. | |
| 4,770,766 | A | 9/1988 | Keller, Jr. et al. | |
| 4,830,637 | A | 5/1989 | Wasson | |
| 5,087,269 | A | 2/1992 | Cha et al. | |
| 5,161,694 | A | 11/1992 | Yoon et al. | |
| 5,236,596 | A | 8/1993 | Greenwald, Sr. | |
| 5,354,345 | A * | 10/1994 | Nehls, Jr. | C10L 9/00 44/626 |
| 5,379,902 | A | 1/1995 | Wen et al. | |
| 5,458,786 | A | 10/1995 | Yoon | |
| 5,459,786 | A | 10/1995 | Tomiyori et al. | |
| 6,053,954 | A * | 4/2000 | Anderson | C10L 1/326 44/280 |
| 6,526,675 | B1 * | 3/2003 | Yoon | C09C 1/42 34/424 |
| 6,632,258 | B1 | 10/2003 | Wheelock et al. | |
| 6,855,260 | B1 | 2/2005 | Yoon | |
| 2003/0146134 | A1 * | 8/2003 | Yoon | B03D 1/006 209/164 |
| 2008/0053914 | A1 | 3/2008 | Yoon | |
| 2011/0277380 | A1 * | 11/2011 | Wibberley | C10L 1/08 44/505 |

FOREIGN PATENT DOCUMENTS

| | | | |
|---|---|---|---|
| CN | 1099318 | A | 3/1995 |
| CN | 101289265 | | 10/2008 |
| RU | 2099146 | C1 | 12/1997 |
| RU | 2182292 | C2 | 5/2002 |
| WO | 2011-094680 | | 8/2011 |

OTHER PUBLICATIONS

Chilean Office Action dated Sep. 29, 2016 in connection with related Chilean Patent Application No. 3345-14.
Supplementary European Search Report dated Feb. 26, 2016 in connection with related European Patent Application No. 13804117.3.
Chinese Office Action dated May 27, 2017 in connection with related Chinese Patent Application No. 201380030621.8.
Chinese Office Action dated Nov. 22, 2016 in connection with related Chinese Patent Application No. 201380030621.8.
Chinese Office Action dated Apr. 6, 2016 in connection with related Chinese Patent Application No. 201380030621.8.
Russian Office Action dated Apr. 26, 2017 in connection with related Russian Patent Application No. 2014152482.
Australian Office Action dated Oct. 8, 2015 in connection with related Australian Patent Application No. 2011210630.
Australian Office Action dated Oct. 10, 2016 in connection with related Australian Patent Application No. 2011210630.
Chinese Office Action dated Jul. 3, 2013 in connection with related Chinese Patent Application No. 201180016309.4.
Chinese Office Action dated Apr. 9, 2014 in connection with related Chinese Patent Application No. 201180016309.4.
Australian Office Action dated Mar. 23, 2017 in connection with related Australian Patent Application No. 2013274408.
International Search Report dated Oct. 18, 2011 in connection with related PCT Patent Application No. PCT/US11/23161.
International Search Report and Written Opinion dated Oct. 18, 2013 in connection with related PCT Patent Application No. PCT/US13/45199.
Binks, B.P.; Particles as Surfactants—Similarities and Differences; Current Opinion in Colloid & Interface Science, vol. 7, 2002, pp. 21-41.
Binks, B.P. et al; Particles Adsorbed at the Oil-Water Interface: A Theoretical Comparison Between Spheres of Uniform Wettability and "Janus" Particles,Langmuir, vol. 17, 2001, p. 4708.
Glaser et al; Janus Particles at Liquid-Liquid Interfaces, Langmuir, vol. 22, 2006, p. 5227.
International Preliminary Report and Written Opinion dated Oct. 18, 2013 in connection with related PCT Patent Application No. PCT/US2013/045199.
Tsai, Shirley Cheng, Fundamentals of Coal Beneficiation and Utilization, Coal Science and Technology 2, Elsevier Scientific Publishing Company, 1982, p. 335.
Capes, C.E. et al., A Survey of Oil Agglomeration in Wet Fine Coal Processing; Power Technology, vol. 40, 1984, p. 43-52.
Keller, Jr., D.V. et al., An Investigation of a Seperation Process involving Liquid-Water-Coal Systems, Colloids and Surfaces, vol. 22, 1987, p. 37-50.
Capes, C.E. et al., A Survey of Oil Agglomeration in Wet Fine Coal Processing; Power Technology, 40, 1984, p. 43-52.
Keller, Jr., D.V. et al., The Demineralization of Coal Using Selective Agglomeration by the T-Process, Coal Preparation, vol. 8, 1990, p. 1-17.
Fuerstenau, Douglas W. et al., Challenges in Mineral Processing, Society of Mining Engineers, Inc., 1989, p. 237-251.
Cooper, M. H. et al., The Licado Coal Cleaning Process: A Strategy For Reducing $SO_2$ Emissions From Fossil-Fuled Power Plants, Proceedings of the 25th Intersociety Energy Conversion Engineering Conference, Aug. 12-17, 1990, p. 137-142.
Rinks, Current Opinion in Colliod and Interface Science, vol. 7, 2002, pp. 21-41.
Pinks et al., Langmuir, vol. 17, 2001, p. 4708.
Glaser et al., Langmuir, vol. 22, 2006, p. 5227.
Smith, K., 'Cleaning and dewatering fine coal using hydrophobic displacement', May 23, 2008, Virginia Polytechnic Institute and State University, [retrieved on Oct. 7, 2016].

* cited by examiner

METHOD OF SEPARATING AND DE-WATERING FINE PARTICLES

CROSS-REFERENCE TO RELATED APPLICATIONS

This application is a continuation of U.S. patent application Ser. No. 13/915,428, filed Jun. 11, 2013, which is a continuation in part of U.S. patent application Ser. No. 13/576,067, filed Jan. 17, 2013, which is a U.S. National Phase Application of PCT/US2011/023161, filed Jan. 31, 2011, which claims the priority of U.S. Provisional Application No. 61/300,270, filed Feb. 1, 2010; and U.S. Provisional Application No. 61/658,153, filed Jun. 11, 2012; which are incorporated herein by reference.

STATEMENT OF GOVERNMENT INTEREST

This invention was made with U.S. Government support under Grant Number DE-FE0000699 awarded by the US Department of Energy. The government has certain rights in the invention.

FIELD OF THE INVENTION

The instant invention pertains to methods of cleaning fine particles, particularly hydrophobic particles such as coal, of its impurities in aqueous media and removing process water from products to the levels that can usually be achieved by thermal drying.

BACKGROUND OF THE INVENTION

Coal is an organic material that is burned to produce heat for power generation and for industrial and domestic applications, it has inclusions of mineral matter and may contain undesirable elements such as sulfur and mercury. Coal combustion produces large amounts of ash and fugitive dusts that need to be handled properly. Therefore, run-of-the mine coal is cleaned of the mineral matter before utilization, which also helps increase combustion efficiencies and thereby reduces $CO_2$ emissions. In general, coarse coal (50×0.15 mm) can be cleaned efficiently by exploiting the specific gravity differences between the coal and mineral matter, while fine coal (approximately 0.15 mm and smaller) is cleaned by froth flotation.

In flotation, air bubbles are dispersed in water in which fine coal and mineral matter are suspended. Hydrophobic coal particles are selectively collected by a rising stream of air bubbles and form a froth phase on the surface of the aqueous phase, leaving the hydrophilic mineral matter behind. Higher-rank coal particles are usually hydrophobic and, therefore, can be attracted to air bubbles that are also hydrophobic via a mechanism known as hydrophobic interaction. The hydrophobic coal particles reporting to the froth phase and subsequently to final product stream are substantially free of mineral matter but contain a large amount of process water. Wet coal is difficult to handle and incurs high shipping costs and lower combustion efficiencies. Therefore, the clean coal product is dewatered using various devices such as cyclones, thickeners, filters, centrifuges, and/or thermal dryers.

Flotation becomes inefficient with finer particles. On the other hand, low-grade ores often require fine grinding for sufficient liberation. In mineral flotation, its efficacy deteriorates rapidly below approximately 10 to 15 μm, while coal flotation becomes difficult below approximately 44 μm.

Furthermore, it is difficult to dewater flotation products due to the large surface area and the high-capillary pressure of the water trapped in between fine particles. Flotation also becomes inefficient when particle size is larger than approximately 150 μm for minerals and 500 μm for coal.

Many investigators explored alternative methods of separating mineral matter from fine coal, of which selective agglomeration received much attention. In this process, which is also referred to as oil agglomeration or spherical agglomeration, oil is added to an aqueous suspension while being agitated. Under conditions of high-shear agitation, the oil breaks up into small droplets, collide with particles, adsorb selectively on coal by hydrophobic interaction, form pendular bridges with neighboring coal particles, and form agglomerates. The high-shear agitation is essential for the formation of agglomerates, which is also known as phase inversion. Nicol et al. (U.S. Pat. No. 4,209,301) disclose that adding oil in the form of unstable oil-in-water emulsions can produce agglomerates without intense agitation. The agglomerates formed by these processes are usually large enough to be separated from the mineral matter dispersed in water by simple screening. One can increase the agglomerate size by subjecting the slurry to a low-shear agitation after a high-shear agitation.

In general, selective agglomeration gives lower-moisture products and higher coal recoveries than froth flotation. On the other hand, it suffers from high dosages of oil.

The amounts of oil used in the selective agglomeration process are typically in the range of 5 to 30% by weight of feed coal (S. C. Tsai, in Fundamentals of Coal Beneficiation and Utilization, Elsevier, 2982, p. 335). At low dosages, agglomerates have void spaces in between the particles constituting agglomerates that are filled-up with water, in which fine mineral matter, e.g., clay, is dispersed, which in turn makes it difficult to obtain low moisture- and low-ash products. Attempts were made to overcome this problem by using sufficiently large amounts of oil so that the void spaces are filled-up with oil and thereby minimize the entrapment of fine mineral matter. Capes et al. (Powder Technology, vol. 40, 1 84, pp. 43-52) disclose that the moisture contents are in excess of 50% by weight when the amount of oil used is less than 5%. By increasing the oil dosage to 35%, the moisture contents are substantially reduced to the range of 17-18%.

Keller et al. (Colloids and Surfaces, vol. 22, 1987, pp. 37-50) increase the dosages of oil to 55-56% by volume to fill up the void spaces more completely, which practically eliminated the entrapment problem and produced super-clean coal containing less than 1-2% ash. However, the moisture contents remained high. Keller (Canadian Patent No. 1,198,704) obtains 40% moisture products using fluorinated hydrocarbons as agglomerants. Depending on the types of coal tested, approximately 7-30% of the moisture was due to the water adhering onto the surface of coal, while the rest was due to the massive water globules trapped in the agglomerates (Keller et al., Coal Preparation, vol. 8, 1990, pp. 1-17).

Smith et al (U.S. Pat. No. 4,244,699) and Keller (U.S. Pat. No. 4,248,698; Canadian Patent No. 1,198,704) use fluorinated hydrocarbon oils with low boiling points (40-159° F.) so that the spent agglomerants can be readily recovered and be recycled, These reagents are known to have undesirable effect on the atmospheric ozone layer. Therefore, Keller (U.S. Pat. No. 4,484,928) and Keller et al. (U.S. Pat. No. 4,770,766) disclose methods of using short chain hydrocarbons, e.g., 2-methyl butane, pentane, and heptane as agglomerants. Like the fluorinated hydrocarbons, these reagents have relatively low boiling points, which allowed them to be recovered and recycled.

Being able to recycle an agglomerant would be a significant step toward eliminating the harrier to commercialization of the selective agglomeration process. Another way to achieve this goal would be to substantially reduce the amount of the oils used. Capes Challenges in Mineral Processing, ed. by K. V. S. Sastry and M. C. Fuerstenau, Society of Mining Engineers, Inc., 1989, pp. 237-251) developed the low-oil agglomeration process, in which the smaller agglomerates (<1 mm) formed at low dosages of oil (0.5-5%) are separated from mineral matter by flotation rather than by screening. Similarly, Wheelock et al., (U.S. Pat. No. 6,632,258) developed a method of selectively agglomerating fine coal using microscopic gas bubbles to limit the oil consumption to 0.3-3% by weight of coal.

Chang et al. (U.S. Pat. No. 4,613,429) disclose a method of cleaning fine coal of mineral matter by selective transport of particles across the water/liquid carbon dioxide interface. The liquid CO2 can be recovered and recycled. A report shows that the clean coal products obtained using this liquid carbon dioxide (LICADO) process contained 5-15% moisture after filtration (Cooper et al., Proceedings of the 25th Intersociety Energy Conversion Engineering Conference, 1990, Aug. 12-17, 1990, pp. 1:37-142).

Yoon et al. (U.S. Pat. No. 5,459,786) disclose a method of dewatering fine coal using recyclable non-polar liquids. The dewatering is achieved by allowing the liquids to displace surface moisture. Yoon et al. report that the process of dewatering by displacement (DBD) is capable of achieving the same or better level of moisture reduction than thermal drying at substantially lower energy costs, but do not show the removal of mineral matter from coal.

As noted above, Keller (Canadian Patent No. 1,198,704) attributed the high moisture contents of the clean coal products obtained from his selective agglomeration process to the presence of massive water globules. Therefore, there remains a need for a process that can be used to clean hydrophobic particles, especially coal, of hydrophilic impurities with low water content.

SUMMARY OF THE INVENTION

It is an object of the instant invention to provide methods for cleaning hydrophobic particulate materials of hydrophilic contaminants. It is also an object to provide a clean hydrophobic fine particulate material that contains moisture levels that is substantially lower than can be achieved by conventional dewatering methods. In this invention, the particulate materials include, but are not limited to, minerals and coal particles smaller than about 1 mm in diameter, preferably smaller than about 0.5 mm, more preferably smaller than about 0.15 mm. Significant benefits of the present invention can be best realized with the ultrafine particles that are difficult to be separated by flotation.

In the instant invention, a hydrophobic liquid is added to an aqueous medium, in which a mixture (or slurry) of hydrophobic and hydrophilic particles are suspended. The hydrophobic liquid is added under conditions of high-shear agitation to produce small droplets. As used herein, "high shear", or the like, means a shear rate that is sufficient to form large and visible agglomerates, which is referred to phase inversion. As noted above, under conditions of high-shear agitation, oil breaks up into small droplets, which collide with the fine particles, and selectively form pendular bridges with neighboring hydrophobic particles, and thereby produce agglomerates of hydrophobic particles. The intensity of agitation required to form the agglomerates should vary depending on particle size, particle hydrophobicity, particle shape, particle specific gravity (S.G.), the type and amounts of hydrophobic liquid used, etc. Ordinarily, agglomerate formation typically occurs at impeller tip speeds above about 35 ft/s, preferably above about 45 ft/s, more preferably above about 60 ft/s. In certain embodiments, the aqueous slurry is subjected to a low-shear agitation after the high-shear agitation to allow for the agglomerates to grow in size, which will help separate the agglomerates from the hydrophilic particles dispersed in the aqueous phase.

The agglomerated hydrophobic particles are separated from the dispersed hydrophilic particles using a simple size-size separation method such as screening. At this stage, the agglomerates are substantially free of the hydrophilic particles, but still contain considerable amount of the process water entrapped in the interstitial spaces created between the hydrophobic particles constituting the agglomerates. The entrapped water also contains dispersed hydrophilic particles dispersed in it.

To remove the entrained water, a second hydrophobic liquid is added to the agglomerates to disperse the hydrophobic particles in the liquid. The dispersion liberates the entrapped process water and the hydrophilic particles dispersed in it from the agglomerates. The hydrophobic particles dispersed in the second hydrophobic liquid are then separated from the hydrophobic liquid. The hydrophobic particles obtained from this final step are practically free of surface water and entrained hydrophilic particles. Typically, the amount of hydrophilic particles associated with the clean hydrophobic particles are less than 10% by weight, preferably less than about 7%, more preferably less than about 3%; and less than about 10% water, preferably less than about 7% water, more preferably less than about 5% water. Importantly, the present invention is able to remove over 90% of hydrophilic particles from the hydrophobic particles, preferably 95%, more preferably 98%; and 95% of water from the hydrophobic particles, preferably 95%, more preferably 99%.

It is, therefore, an object of the invention to separate hydrophobic particles from hydrophilic particles and simultaneously remove the water from the product using a hydrophobic liquid. The hydrophobic-hydrophilic separation (MS) process described above can also be used to separate of one type of hydrophilic particles from another by hydrophobizing a selected component using an appropriate method. The invention, for example, may be practiced with different types of coal including without limitation bituminous coal, anthracite, and subbituminous coal.

It is another object of this invention to further reduce the moisture of clean coal product to the extent that they can be dried without using excessive heat, and thus energy.

It is still another object to recover the spent hydrophobic liquid for recycling purposes.

DETAILED DESCRIPTION OF THE PREFERRED EMBODIMENTS

Figure 1:
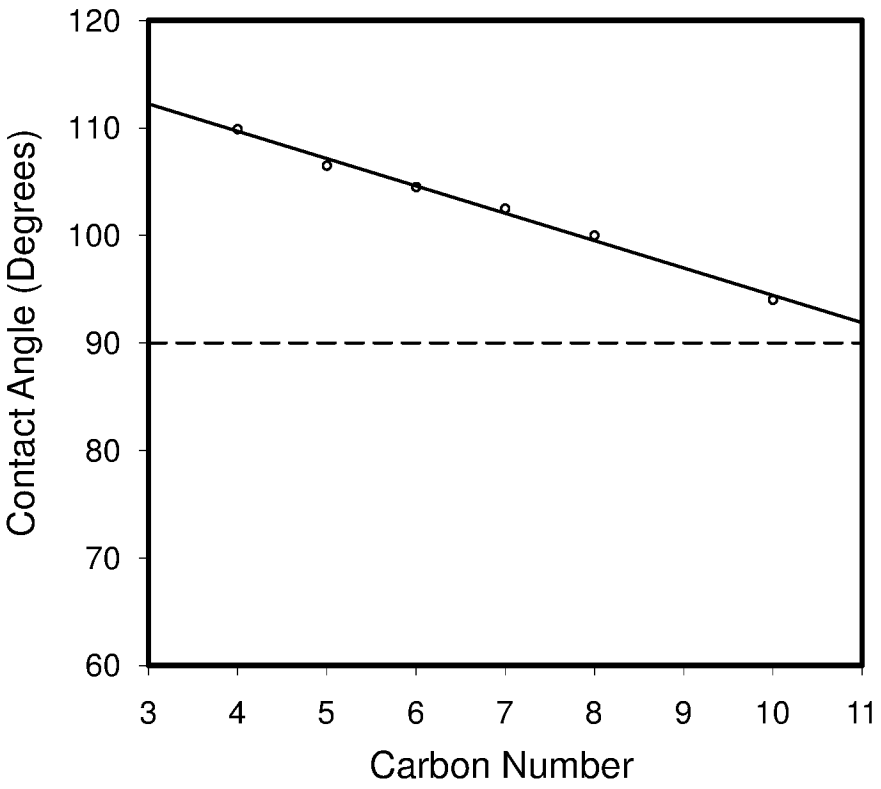
FIG. 1 is a graph showing the contact angles of n-alkanes on a hydrophobic coal immersed in water (Yoon et al., PCT Application No. 61/300,270, 2011) that are substantially larger than those (~65°) of water droplets on most hydrophobic coal (Gutierrez-Rodriguez, et al., Colloids and Surfaces, 12, p. 1, 1984).

The present invention provides methods of separating a mixture of hydrophobic fine particulate materials suspended in water. It is also an object to dewater at least one of the products to a level that is substantially lower than can be achieved by conventional dewatering methods. In this invention, the fine particulate materials include but not limited to minerals and coal particles, smaller than about 1 mm in diameter, preferably smaller than about mm, more preferably smaller than about 0.5 mm more preferably less than about 0.15 mm. The hydrophobic particulate materials amenable to the present invention include, but are not limited to, coal, base-metal sulfides, precious metallic minerals, platinum group metals, rare earth minerals, non-metallic minerals, phosphate minerals, and clays.

The present invention provides a method of separating hydrophobic and hydrophilic particles from each other in two steps: 1) agglomeration of the hydrophobic particles in a first hydrophobic liquid/aqueous mixture; followed by 2) dispersion of the agglomerates in a second hydrophobic liquid to release the water trapped within the agglomerates along with the entrained hydrophilic particles. The second hydrophobic liquid can be the same as the first hydrophobic liquid in many cases. Essentially, the agglomeration step removes the bulk of hydrophilic particles and the water from the fine hydrophobic particles by selectively agglomerating the latter; and the dispersion step removes the residual process water entrapped within the structure of the agglomerates.

In the agglomeration step, a hydrophobic liquid is added to an aqueous medium, in which a mixture (or slurry) of fine hydrophobic (usually the product of interest) and hydrophilic (the contaminants) particles are suspended. The hydrophobic liquid is added under conditions of high-shear agitation to produce small droplets. The agitation must be sufficient to induce agglomeration of the hydrophobic particles. In general, the probability of collision between oil droplets and fine particles increases with decreasing droplet size. Further, the high-shear agitation helps prevent and/or minimize the formation of oil-in-water emulsions stabilized by hydrophobic particles. The hydrophobic liquid is chosen such that its contact angle (θ) on the surface, as measured through aqueous phase, is larger than 90°. Use of such a liquid allows it to spontaneously displace the moisture from the surface. High shear agitation produces small oil droplets that are more efficient than larger droplets for collecting the hydrophobic fine particles and forming agglomerations of those particles. The hydrophilic particles (usually undesired material) remain in the aqueous phase.

When oil and water are mixed in the presence of spherical particles, water-in-oil emulsions are formed when $\theta>90°$, and oil-in-water emulsions are formed when $\theta<90°$ (Blinks, B. P., Current Opinion in Colloid and Interface Science, 7, p. 1, 2002). The former is likely the case when using the hydrophobic liquids that give contact angles greater than 90°. In the instant invention, this problem is eliminated and/or minimized by adding a hydrophobic liquid to aqueous slurry under conditions of high-shear agitation.

While high-shear agitation can minimize the formation of water-in-oil emulsions, it may not prevent the residual process water from being entrapped in the interstitial spaces created in between the particles constituting agglomerates, in the dispersion step, the entrapped water can be removed by breaking the agglomerates and dispersing the hydrophobic particles in a hydrophobic liquid. The hydrophobic particles readily disperse in a hydrophobic liquid due to the strong attraction between hydrophobic particles and hydrophobic liquid. On the other hand, water has no affinities toward either the hydrophobic particles or the hydrophobic liquid; therefore, it is released (or liberated) from the agglomerates and are separated from the hydrophobic particles. During the dispersion step, the hydrophilic particles in the entrained water are also removed, providing an additional mechanism of separating hydrophobic and hydrophilic particles from each other.

The bulk of the hydrophobic liquid used in the instant invention is recovered for recycle purpose without involving phase changes by using appropriate solid-liquid separation means such as settling, filtration, and centrifugation. Only the small amount of the residual hydrophobic liquid adhering onto the surface of hydrophobic particles can be recovered by vaporization and condensation. Thermodynamically, the energy required to vaporize and condense the recyclable hydrophobic liquids disclosed in the instant invention is only a fraction of what is required to vaporize water from the surface of hydrophobic particulate materials, In floatation, for a bubble to collect a hydrophobic particle on its surface, the thin liquid film (TLF) of water (or wetting film) formed in between must thins and ruptures rapidly during the short time frame when the bubble and particle are in contact with each other. In a dynamic flotation cell, the contact times are very short typically in the range of tens of milliseconds or less. If the film thinning kinetics is slow, the bubble and particle will be separated from each other before the film ruptures. It has been shown that the kinetics of film thinning increases with increasing particle hydrophobicity (Pan et al., Faraday Discussion, 146, p. 325, 2010). Therefore, various hydrophobizing agents, called collectors, are used to increase the particle hydrophobicity and facilitate the film thinning process.

At the end of a film thinning process, the film must rupture to form a three-phase. A wetting film can rupture when the following thermodynamic condition is met, $$\gamma_S-\gamma_{SW}<\gamma_W \quad [1]$$

where $\gamma_S$ is the surface free energy of a solid (or particle) in contact with air, while $\gamma_{SW}$ and $\gamma_W$ are the same at the solid/water and water/air interfaces, respectively. The term on the left, i.e., $\gamma_S-\gamma_{SW}$, is referred to as wetting tension. Eq. [1] suggests that a particle can penetrate the TLF and from a three-phase contact if the film tension is less than the surface tension of water. The free energy gained during the film rupture process (ΔG) is given by $\gamma_S-\gamma_{SW}-\gamma_W$; therefore, the lower the wetting tension, the easier it is to break the film.

It follows also that for a wetting tension to be small, it is necessary that $\gamma_{SW}$ be large. According to the acid-base interaction theory (van Oss, C. J., Interfacial Forces in Aqueous Media, CRC Taylor and Francis, $2^{nd}$ Ed., p. 160), the solid/water interfacial tension can be calculated by the following relation, $$\gamma_{SW}=\gamma_S\gamma_W-2\sqrt{\gamma_S^{LW}\gamma_W^{LW}}-2\sqrt{\gamma_S^{+}\gamma_W^{-}}-2\sqrt{\gamma_S^{-}\gamma_W^{+}} \quad [2]$$

where $\gamma_S^{LW}$ is the Lifshitz-van der Waals component of $\gamma_S$ and $\gamma_W^{LW}$ is the same of $\gamma_W$; $\gamma_S^{+}$ and $\gamma_S^{-}$ are the acidic and basic components of $\gamma_S$, respectively; and $\gamma_W^{+}$ and $\gamma_W^{-}$ are the same for water. Essentially, the acidic and basic components represent the propensity for hydrogen bonding. According to Eq. [2], it is necessary to keep $\gamma_S^{+}$ and $\gamma_S^{-}$ small to increase $\gamma_{SW}$, which can be accomplished by rendering the surface more hydrophobic. When a surface becomes more hydrophobic, $\gamma_S$ decreases also, which helps decrease the wetting tension and hence improve flotation.

In the present invention, a hydrophobic liquid (oil), rather than air, is used to collect hydrophobic particles. In this case, oil-particle attachment can occur under the following condition, $$\gamma_{SO}-\gamma_{SW}<\gamma_W \quad [3]$$

where $\gamma_{SO}$ represents the interfacial tension between solid and oil. According to the acid-base theory, $$\gamma_{SO}=\gamma_S+\gamma_O-2\sqrt{\gamma_S^{LW}\gamma_O^{LW}}-2\sqrt{\gamma_S^{+}\gamma_O^{-}}-2\sqrt{\gamma_S^{-}\gamma_O^{+}} \quad [4]$$

where the subscript O represents hydrophobic liquid phase. The hydrophobic liquids that can be used in the instant invention include, but are not limited to, n-alkanes (such as petane, hexane, and heptanes), n-alkenes, unbranched and branched cycloalkanes and cycloalkenes with carbon numbers of less than eight, ligroin, naphtha, petroleum naptha, petroleum ether, liquid carbon dioxide, and mixtures thereof. The acidic and basic components of these hydrophobic liquids, i.e., $\gamma_O^-$ and $\gamma_O^+$, are zero as they cannot form hydrogen bonds with water, which makes the last two terms of Eq. [4] to drop out. Since $\gamma_O$ is nonzero, one may be concerned that $\gamma_{SO}>\gamma_S$. However, the value of the third term of Eq. [4], i.e., $2\sqrt{\gamma_S^{LW}\gamma_O^{LW}}$, is substantial. For n-pentane interacting with Teflon, for example, $\gamma_O$=16.05 mJ/m$^2$ and $\gamma_S$=17.9 mJ/m$^2$. Since both of these substances are completely non-polar, $\gamma_O=\gamma_O^{LW}$ and $\gamma_S^{LW}$. From those values, one obtains the fourth term to be −33.9 mJ/m$^2$, the magnitude of which is larger than that of $\gamma_O$. Therefore, in reality $\gamma_{SO}<\gamma_S$ and hence, $$\gamma_{SO}-\gamma_{SW}<\gamma_S-\gamma_{SW} \quad [5]$$

which suggests that the wetting film formed between n-pentane and a hydrophobic surface can more readily rupture than the same formed between air bubble and a hydrophobic surface.

According to the inequality of Eq. [5], an oil droplet placed on a hydrophobic surface immersed in water should give a higher contact angle than an air bubble can. FIG. 1 shows the contact angles of various n-alkane hydrocarbons placed on a hydrophobic coal. As shown, all of the contact angles are larger than 90° and increase with decreasing hydrocarbon chain length. In comparison, the maximum contact angles of the air bubbles adhering on the surface of the most hydrophobic bituminous coal placed in water is approximately 65° (Gutierrez-Rodriguez, et al., Colloids and Surfaces, 12, p. 1, 1984). The large differences between the oil and air contact angles supports the thermodynamic analysis presented above and clearly demonstrates that oil is better than air bubble for collecting hydrophobic particles from an aqueous medium.

When an air bubble encounters a particle during flotation, it deforms and causes a change in curvature, which in turn creates an excess pressure (p) in the wetting film. The excess pressure created by the curvature change ($p_{cur}$) can be predicted using the Laplace equation; therefore, it is referred to as Laplace pressure or capillary pressure. The excess pressure causes a wetting film to drain. When its film thickness (h) reaches ~200 nm, the surface forces (e.g., electrical double-layer and van der Waals forces) present at the air/water and bitumen/water interfaces interact with each other and give rise to a disjoining pressure (Π). A pressure balance along the direction normal to a film shows that the excess pressure becomes equal to the Laplace pressure minus disjoining pressure, i.e., $p=p_{cur}-\Pi$. Under most flotation conditions, both the double-layer and van der Waals forces are repulsive (or positive) in wetting films, causing the excess pressure to decrease and hence the film thinning process be retarded.

The disjoining pressure can become negative when the particle becomes sufficiently hydrophobic by appropriate chemical treatment. In this case, the excess pressure (p) in the film will increase and hence accelerate the film thinning process. It has been shown that the negative disjoining pressures (Π<0) are created by the hydrophobic forces present in wetting films. In general, hydrophobic threes and hence the negative disjoining pressures increase with increasing particle hydrophobicity or contact angle (Pan et al., Faraday Discussion, vol. 146, 325-340, 2010).

Thus, it is essential to render a particle sufficiently hydrophobic for successful flotation. An increase in particle hydrophobicity should cause the wetting film to thin faster, while at the same time cause the wetting tension to decrease. If the wetting tension becomes less than the surface tension of water, then the wetting film ruptures, which is the thermodynamic criterion for bubble-particle attachment.

A fundamental problem associated with the forced air flotation process as disclosed by Sulman et al. (U.S. Pat. No. 793,808) is that the van der Waals force in wetting films are always repulsive, contributing to positive disjoining pressures which is not conducive to film thinning. When using oil to collect hydrophobic particles, on the other hand, the van der Waals forces in wetting films are always attractive, causing the disjoining pressures to become negative. As discussed above, a negative disjoining pressure causes an increase in excess pressure in the film and hence facilitates film thinning. For the reasons discussed above, oil agglomeration should have faster kinetics and be thermodynamically more favorable than air bubble flotation. An implication of the latter is that oil agglomeration can recover less hydrophobic particles, has higher kinetics, and gives higher throughput.

In the instant invention, the hydrophobic liquid is dispersed in aqueous slurry. In general, the smaller the air bubbles or oil droplets, the higher the probability of collision, which is a prerequisite for bubble-particle or oil-particle attachment. At a given energy input, it would be easier to disperse oil in water than to disperse air in water. The reason is simply that the interfacial tensions at the oil-water interfaces are in the range of 50 mJ/m$^2$, while the same at the air/water interface is 72.6 mJ/m$^2$.

In the instant invention, hydrophobic liquid, rather than air, is used to collect hydrophobic particles to take advantage of the thermodynamic and kinetic advantages discussed above. On the other hand, hydrophobic liquid is generally more expensive than air to use. Further, oil flotation products have high moistures. In the instant invention, the first problem is overcome by using hydrophobic oils that can be readily recovered and recycled after use, while the second problem is addressed as discussed below.

There are three basic causes for the high moisture content in oil agglomeration products (the agglomerated fine particles recovered by hydrophobic/hydrophilic separation). They include i) the film of water adhering on the surface of the hydrophobic particles recovered by oil flotation; ii) the water-in-oil emulsions (or Pickering emulsions) stabilized by the hydrophobic particles; and iii) the water entrapped in the interstitial void spaces created by the hydrophobic particles constituting agglomerates. In the instant invention, the water from i and ii are removed in the agglomeration stage by selecting a hydrophobic liquid with contact angle greater than 90°. The surface moisture (mentioned in i) is removed by using a hydrophobic liquid that can displace the water from the surface. Thermodynamically, the surface moisture can be spontaneously displaced by using a hydrophobic liquid whose contact angles are greater than 90°.

The water entrainment in the form of water-in-oil emulsions (mentioned in ii) is eliminated by not allowing large globules of water to be stabilized by hydrophobic particles. This is accomplished by subjecting aqueous slurries to high-shear agitation. Preferably, the high shear agitation produces hydrophobic liquid droplet sizes to be smaller than the air bubbles used in flotation, which allows the process of the instant invention to be more efficient than flotation. Typically, the droplet sizes are in the range of 0.1 to 400 μm, preferably 10 to 300 μm, more preferably 100 to 200 μm. The agitation can be accomplished by using a dynamic mixer or an in-line mixer known in the art. In-line mixers are designed to provide a turbulent mixing while slurries are in transit.

Under conditions of high-shear agitation, hydrophobic particles can be detached from oil-water interface and, thereby, destabilize water-in-oil emulsions or prevent them from forming. The amount of energy (E) required to detach hydrophobic particles from the interface can be calculated by the following relation (Pinks, B. P., Current Opinion in Colloid and Interface Science, 7, 2002, p. 21), $$E=\Pi^2\gamma_{O/W}(1\pm\cos\theta) \quad [6]$$

where $\gamma_{O/W}$ is the interfacial tension, r is particle radius, and θ is the contact angle. The sign inside the bracket is positive for removal into hydrophobic phase and is negative for removal into water phase. Therefore, the higher the contact angle, the easier it is to remove particles to the hydrophobic phase. Conversely, the lower the contact angle, the easier it is to remove particles to water phase. Thus, the high-shear agitation employed in the instant invention offers a mechanism by which less hydrophobic particles are dispersed in water phase, while more hydrophobic particles are dispersed in oil phase. Eq. [6] suggests also that the smaller the particles, the easier it is to detach particles from the oil-water interface and achieve more complete dispersion.

The interstitial water trapped in between hydrophobic particles (mentioned in iii) is removed by dispersing the agglomerates in a second hydrophobic liquid. Upon dispersion, the trapped interstitial water is liberated from the agglomerates and are separated from the hydrophobic particles and subsequently from the hydrophobic liquid. As has already been noted in conjunction with Eq. [6], the smaller the particles and the higher the contact angles, the easier it is to disperse agglomerates into the hydrophobic liquid in which the hydrophobic particles are dispersed. The second hydrophobic liquid (used for dispersion) can be the same of different from the hydrophobic liquid used in the agglomeration step. The second hydrophobic liquid can be, but is not limited to, n-alkanes (such as petane, hexane, and heptanes), n-alkenes, unbranched and branched cycloalkanes and cycloalkenes with carbon numbers of less than eight, ligroin, naphtha, petroleum naptha, petroleum ether, liquid carbon dioxide, and mixtures thereof.

The hydrophobic liquid recovered from the process is preferably recycled. The hydrophobic particles obtained from the solid/liquid separation step are substantially free of surface moisture. However, a small amount of the hydrophobic liquid may be present on the coal surface, in which case the hydrophobic particles may be subjected to a negative pressure or gentle heating to recover the residual hydrophobic liquid as vapor, which is subsequently condensed back to a liquid phase and recycled.

Figure 2:
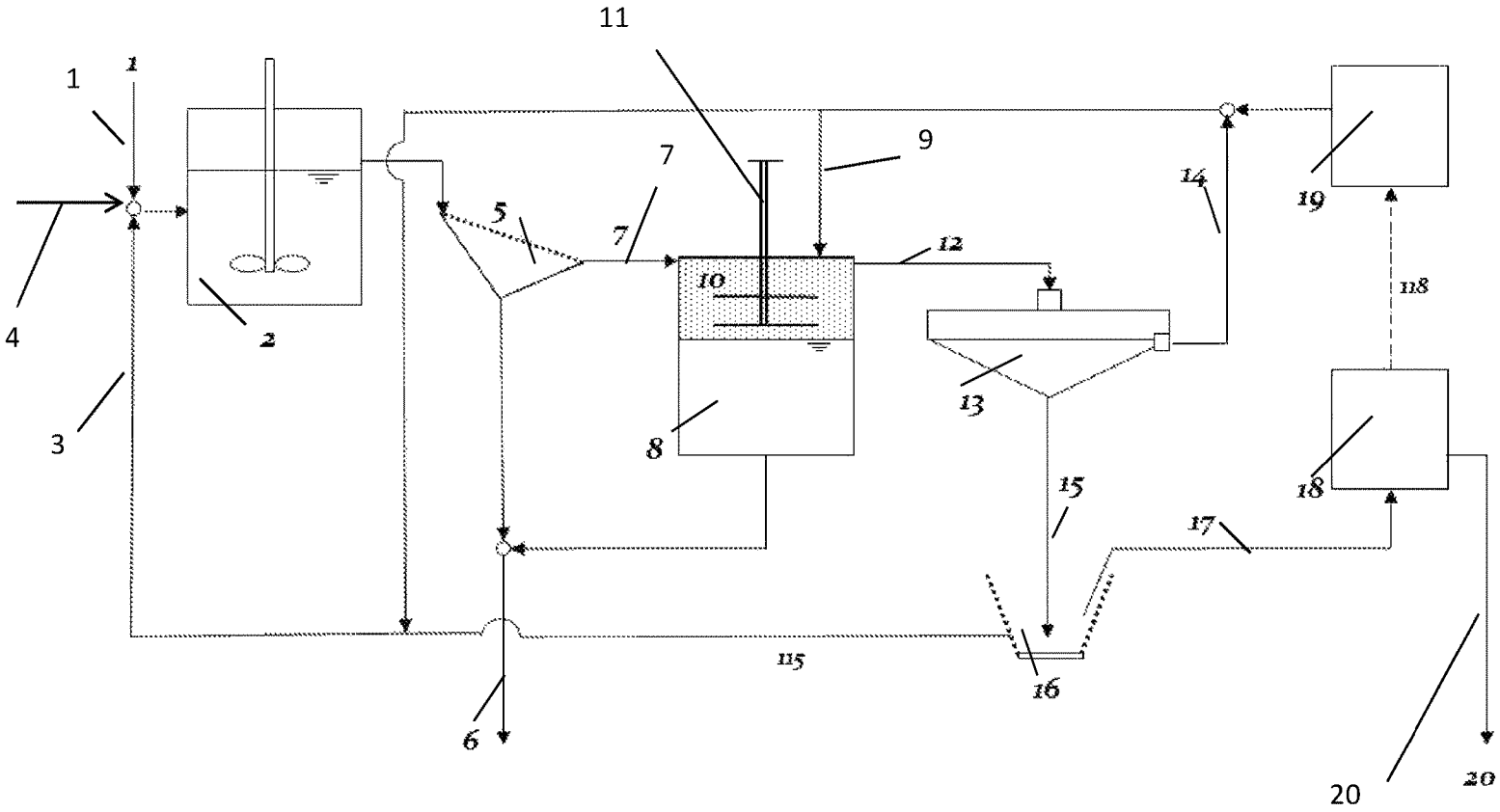
FIG. 2 is a schematic of one embodiment of the process as disclosed in the present invention.

FIG. 2 shows an embodiment of the instant invention. A mixture of hydrophobic and hydrophilic particulate materials dispersed in water (stream 1) is fed to a mixing tank 2, along with the hydrophobic liquid recovered downstream (stream 3) and a small amount of make-up hydrophobic liquid (stream 4). The aqueous slurry and hydrophobic liquid in the mixing tank 2 is subjected to a high-shear agitation, e.g. by means of a dynamic mixer as shown to break the hydrophobic liquid into small droplets and thereby increase the efficiency of collision between particles and hydrophobic liquid droplets. As noted above, collision efficiency with fine particles should increase with decreasing droplet size. Further, high-shear agitation is beneficial for preventing entrainment of water into the hydrophobic liquid phase in the form of water-in-oil emulsions. Upon collision, the wetting films between oil droplets and hydrophobic particles thin and rupture quickly due to the low wetting tensions and form agglomerates of the hydrophobic particulate material, while hydrophilic particles remain dispersed in water. The agitated slurry flows onto a screen 5 (or a size separation device) by which hydrophilic particles (stream 6) and agglomerated hydrophobic particles (stream 7) are separated. The latter is transferred to a tank 8, to which additional (or a second) hydrophobic liquid 9 is introduced to provide a sufficient volume of the liquid in which hydrophobic particles can be dispersed. A set of vibrating meshes 10 installed in the hydrophobic liquid phase provides a sufficient energy required to break the agglomerates and disperse the hydrophobic particles in the hydrophobic liquid phase. Vibrational frequencies and amplitudes of the screens are adjusted by controlling the vertical movement of the shaft 11 holding the screens. Other mechanical means may be used to facilitate the breakage of agglomerates. The hydrophobic particles dispersed in hydrophobic liquid (stream 12) flows to a thickener 13, in which hydrophobic particles settle to the bottom while clarified hydrophobic liquid (stream 14) is returned to the mixer 2 (in this case, the hydrophobic liquids in the agglomeration and dispersion steps are the same). The thickened oily slurry of hydrophobic particles 15 at the bottom of the thickener 13 is sent (stream 15) to a solid-liquid separator 16, such as centrifuge or a filter. The hydrophobic particles (stream 17) exiting the solid-liquid separator 16 are fed to a hydrophobic liquid recovery system consisting of an evaporator 18 and/or a condenser 19. The condensate is recycled back to the mixer 2. The hydrophobic particles (stream 20) exiting the evaporator 18 are substantially free of both moisture and of hydrophilic impurities. The hydrophilic particles recovered from the screen 5 and the disperser 8 may be rejected or recovered separately.

The hydrophobic liquids that can be used in the process described above include shorter-chain n-alkanes and alkenes, both unbranched and branched, and cycloalkanes and cycloalkenes, with carbon numbers less than eight. These and other hydrophobic liquids such as ligroin (light naphtha), naphtha and petroleum naphtha, and mixtures thereof have low boiling points, so that they can be readily recovered and recycled by vaporization and condensation. Liquid carbon dioxide ($CO_2$) is another that can be used as a hydrophobic liquid in the instant invention. When using low-boiling hydrophobic liquids, it may be necessary to carry out the process described in FIG. 2 in appropriately sealed reactors to minimize the loss of the hydrophobic liquids by vaporization.

When processing high-value fine particulate materials, such as precious metals, platinum group metals (PGM), and rare earth minerals, it may not be necessary to recycle the spent hydrophobic liquids. In this case, hydrocarbons of higher carbon numbers, such as kerosene, diesel, and fuel oils may be used without provisions for recycling. When using those hydrophobic liquids, the instant invention can be similar to the conventional oil agglomeration process, except that agglomeration products are dispersed in a suitable hydrophobic liquid to obtain lower-moisture and lower-impurity products.

In the process diagram presented in FIG. 2, a hydrophobic particulate material (e.g., high-rank coals) is separated from hydrophilic materials (e.g., silica and clay), with the resulting hydrophobic materials having very low surface moistures.

The processes as described in the instant invention can also be used for separating one-type of hydrophilic materials from another by selectively hydrophobizing one but not the other(s). For example, the processes can be used to separate copper sulfide minerals from siliceous gangue minerals by using an alkyl xanthate or a thionocarbamate as hydrophobizing agents for the sulfide minerals. The hydrophobized sulfide minerals are then separated from the other hydrophilic minerals using the process of the present invention.

Further, the process disclosed in the instant invention can be used for further reducing the moisture of the hydrophobic particulate materials dewatered by mechanical dewatering methods. For example, a filter cake consisting of hydrophobic particles can be dispersed in a hydrophobic liquid to remove the water entrapped in between the void spaces of the particles constituting the filter cake, and the hydrophobic liquid is subsequently separated from the dispersed hydrophobic particles and recycled to obtain low-moisture products.

In addition, the process disclosed in the instant invention can be used for dewatering low-rank coals. This can be accomplished by heating a coal in a hydrothermal reactor in the presence of $CO_2$. The water derived from the low-rank coal is displaced by liquid $CO_2$ in accordance to the DBD and the HHS mechanisms disclosed above. The product coal obtained from this novel process will be substantially free of water and can be transported under $CO_2$ atmosphere to minimize the possibility of spontaneous combustion.

Further, low-rank coals can be dewatered and upgraded by the present invention by derivatizing the low-rank coal to make it hydrophobic. It is well known that low-rank coals are not as hydrophobic as high-rank coals, such as bituminous coal and anthracite. Some are so hydrophilic that flotation using conventional coal flotation reagents, such as kerosene and diesel oils do not work. Part of the reasons is that various oxygen containing groups such as carboxylic acids are exposed on the surface. When a low-rank coal is upgraded in accordance to the present invention, it is preferably derivatized to render the surface hydrophilic surface hydrophobic. In one embodiment, the low-rank coal is first esterified with an alcohol, e.g. methanol, ethanol, and the like, using methods known in the art. The esterification renders the low-rank coal more hydrophobic (than before esterification). The reaction between the carboxyl groups (R—COOH) of the low-rank coal and alcohol (R—OH) is indicated as follows:

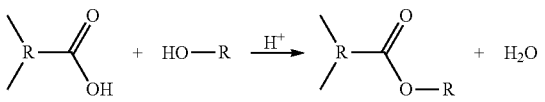

The reaction produces esters (R—COOR) on the surface of the low-rank coal and water. Preferably, the reaction takes place at about 25-75° C., more preferably about 45-55° C., and most preferably at about 50° C. A catalyst, such as H ions may also be used for the esterification. The production of water by the condensation reaction represents a mechanism by which "chemically-bound" water is removed, while the substitution of the hydrophilic carboxyl groups with short hydrocarbon chains (R) renders the low-rank coal hydrophobic. Once esterified, the low-rank coal can be subjected to the HHS process disclosed in the instant invention to remove the residual process water and the entrained hydrophilic mineral using the agglomeration/dispersion steps as disclosed in the present invention.

Without further description, it is believed that vie of ordinary skill in the art can, using the preceding description and the following illustrative examples, make and utilize the present invention. The following examples are given to illustrate the present invention. It should be understood that the invention is not to be limited to the specific conditions or details described in the examples.

Example 1

A sample of rougher concentrate was received from a chalcopyrite flotation plant operating in the U.S. The sample assaying 15.9% Cu was wet ground in a laboratory ball mill for 12.5 hours to reduce the particle size to 80% finer than 20 μm. The mill product was subjected to a standard flotation test, and the results were compared with those obtained from an oil agglomeration test. In each test, a 100 g mill product was treated with 4 lb/ton of potassium amyl xanthate (KAX) to selectively hydrophobize chalcopyrite.

The flotation test was conducted using a Denver laboratory flotation cell. The oil agglomeration test was conducted using a kitchen blender with 100 g mill product, 80 ml n-pentane, and 400 ml tap water. The mixture was subjected initially to a high-shear agitation for 40 s and subsequently to a low shear agitation for another 40 s. Here, the dividing line between the high- and low-shear agitations is the impeller speed that can create agglomerates of hydrophobic (and/or hydrophobized) particles, which is referred to as phase inversion. For the case of bituminous coal, the phase inversion occurs at the rotational speeds above approximately 8,000 r.p.m. The slurry in the blender was then poured over a screen to separate the agglomerated hydrophobized chalcopyrite particles from the dispersed hydrophilic siliceous gangue. The agglomerates recovered as screen overflow were then dispersed in n-pentane, while being agitated by means of an ultrasonic vibrator to assist dispersion. The hydrophobized chalcopyrite particles dispersed in pentane were then separated from pentane and analyzed for copper and moisture.

As shown in Table 1, oil agglomeration gave 92.3% copper recovery, as compared to 55.4% recovery obtained by flotation. The large improvement can be attributed to the differences in wetting tensions and the nature of the van der Waals forces present in the respective wetting films. On the other hand, the oil agglomeration test gave a little lower copper grade than the flotation test.

A problem associated with the oil agglomeration process was that the moisture content of the agglomerates was high (48.6%) due to the presence of the water trapped within the agglomerate structure. It was possible, however, to overcome this problem by dispersing the agglomerates in a hydrophobic liquid (n-pentane) and thereby liberating the residual process water entrapped within the agglomerate structure. The moisture content of the chalcopyrite concentrate obtained in this manner was only 0.6%, as shown in Table 1.

TABLE 1

| | Copper | | | |
|---|---|---|---|---|
| | Recovery | Grade | Moisture (% wt) | |
| | (%) | (% Cu) | Agglomerates | Dispersed |
| Flotation | 55.4 | 28.0 | — | — |
| Agglomeration | 92.3 | 23.1 | 48.6 | 0.6 |

This example shows that oil droplets are more efficient than air bubbles for the recovery of ultrafine hydrophobic particles from aqueous media, and that that the HHS process can be used to overcome the high moisture problem associated with the oil agglomeration process.

Example 2

In this example, the process of the present invention was compared with flotation. The copper rougher concentrate assaying 15.9% Cu was wet ground in a ball mill using tap water. The grinding times were varied to obtain mill products of different particle sizes, and the products were subjected to both flotation and HHS tests.

Table 2 compares the flotation and HHS test results obtained on a mill product with a particle size distribution of 80% finer than 22 μm. Each test was conducted using ~250 g samples with 17.6 lb/ton potassium amyl xanthate (KAX) as a selective hydrophobizing agent (collector) for the copper mineral (chalcopyrite). As shown, flotation gave a concentrate assaying 28.0% Cu with a 67.4% copper recovery, while the HHS process gave a concentrate assaying 23.1% Cu with a 91.9% recovery. In the latter, the mill product was first agglomerated with pentane in a kitchen blender, which provided a high-shear agitation, and the agglomerates were subsequently separated from dispersed materials by means of a screen. The agglomerates were then dispersed in pentane so that the residual process water entrapped within the agglomerate structure is liberated from the agglomerates. A gentle mechanical agitation facilitated the dispersion by breaking the agglomerates.

TABLE 2

| | | Weight | | Assays (% wt) | | Copper Re- |
|---|---|---|---|---|---|---|
| | Products | grams | % wt | Cu | Moistur | covery |
| Flotation | Concentrate | 151.1 | 68.6 | 28.0 | — | 67.4 |
| | Tailing | 69.2 | 31.4 | 8.4 | — | — |
| | Feed | 220.3 | 100.0 | 15.9 | — | — |
| Hydrophobic-Hydrophilic Separation (HHS) | Concentrate | 238.2 | 98.3 | 23.1 | 0.14 | 91.9 |
| | Tailing | 4.0 | 1.7 | 3.5 | — | — |
| | Feed | 242.2 | 100.0 | 15.9 | — | — |

The results presented in the table demonstrated that the present invention is more efficient in recovering fine particles. That the present process gave a slightly lower copper grade than the flotation process can be attributed to high recovery. Since the droplets of hydrophobic liquid (pentane) are more efficient than air bubbles in collecting hydrophobic particles, the former can recover composite particles that are less hydrophobic than fully liberated chalcopyrite particles, resulting in a lower-grade product. When the present process (HHS) was conducted at lower dosages of xanthate, the concentrate grade was improved.

Example 3

Monosized silica spheres of 11 μm in diameter were hydrophobized and subjected to oil agglomeration, followed by a dispersion step as described in the foregoing examples. The silica particles were hydrophobized by immersing them in a 0.002 moles/liter octadecyltrichlorosilane (OTS) solution. After a 10 minute immersion time, the particles were washed with toluene and subsequently with ethanol to remove the residual OTS molecules adhering on the surface.

An aqueous suspension containing 50 g of the hydrophobized silica at 10% solids was placed in a kitchen blender and subjected to a high-shear agitation for 40 s in the presence of 20 ml of n-pentane, followed by 40 s of low-shear agitation. The agglomerates showed 19.5% moisture by weight.

The agglomerates were then dispersed in n-pentane while being agitated mechanically to facilitate the breakage of the agglomerates and thereby release the water trapped in between hydrophobic particles. The mechanical device that was used to help break the agglomerates was a set of vibrating meshes located in the pentane phase. The tiny water droplets liberated from the agglomerates fall to the bottom, while the hydrophobic particles remain dispersed in the organic phase. The hydrophobic particles separated from the organic phase were practically dry containing only 0.7% by weight of moisture. This example clearly demonstrates that the process of the present invention is efficient for recovering and dewatering ultrafine particles.

Example 4

Fundamentally, dewatering is a process in which solid/water interface is replaced by solid/air interface. For hydrophobic solids, the interfacial free energies at the solid/oil interface ($\gamma_{SO}$) is lower than the same at the solid/air interface ($\gamma_S$) as discussed in view of Eqs. [4] and [5]. It should, therefore, be easier to displace the solid/water interface with solid/oil interface than with solid/air interface.

In this example, 200 ml of tap water and 50 g of monosized silica particles of 71 μm agitated in a kitchen blender for a short period of time to homogenize the mixture. A known volume of a cationic surfactant solution, i.e., $4\times10^{-6}$ M dodecylaminium hydrochloride (DAH), was then added to the mixture. The slurry was agitated for 3 minutes at a low speed to allow for the surfactant molecules to adsorb on the surface and render the silica surface hydrophobic. A volume of n-pentane (25 ml) was then added before agitating the slurry at a high speed for 40 s, followed by another 40 s of agitation at a low speed. The agitated slurry was poured over a screen to separate the agglomerates, formed in the presence of the hydrocarbon oil, from the water. The agglomerates were analyzed for surface moisture after evaporating the residual n-pentane adhering on the silica surface. The tests were conducted at different DAH dosages, with the results being presented in Table 3. As shown, the moisture of the agglomerates decreased with increasing DAH dosages. Nevertheless, the moistures remained high due to the presence of the water trapped in between the particles constituting the agglomerates.

TABLE 3

| DAH Dosage | Moisture (% wt) | |
|---|---|---|
| (lb/ton) | Agglomerate | Dispersed |
| 2.2 | 24.20 | 7.8 |
| 4.4 | 23.67 | 0.9 |
| 15 | 22.5 | 0.06 |

Another set of agglomeration tests were conducted under identical conditions. In this set of experiments, the agglomeration step was followed by another step, in which the agglomerates were added to a beaker containing 100 ml of n-pentane. After a gentle agitation by hand, the hydrophobic silica particles dispersed in pentane was transferred to a Buchner filter for solid-liquid separation. Additional pentane was added to ensure that most of the entrapped water was displaced by the hydrophobic liquid. The filter cake was analyzed for moisture after evaporating the residual n-pentane from the surface. As shown in Table 3, the moisture contents of the filtered silica were substantially lower than those of the agglomerates.

Example 5

Screen-bowl centrifuges are widely used to dewater clean coal products from flotation. However, the process loses ultrafine particles smaller than 44 μm as effluents. In this example, a screen-bowl effluent received from an operating bituminous coal cleaning plant was first subjected to two stages of flotation to remove hydrophilic clay, and the froth product was dewatered by vacuum filtration. The cake moisture obtained using sorbitanmonooleate as a dewatering aid was 20.2% by weight. The filter cake was then dispersed in a hydrophobic liquid (n-pentane) while the slurry was being agitated by sonication to facilitate the breakage of the agglomerate. Since the bituminous coal particles are hydrophobic, they can readily be dispersed in the hydrophobic liquid, while the water droplets trapped in between the particles were released and fall to the bottom. The ultrafine coal particles dispersed in the hydrophobic liquid phase contained only 2.3% moisture, as analyzed after appropriately separating the n-pentane from the coal. The results obtained in this example showed that most of the moisture left in the filter cake was due to the water trapped in the void spaces in between the particles constituting the cake, and that it can be substantially removed by the method disclosed in the instant invention.

Example 6

Recognizing the difficulty in cleaning and dewatering ultrafine coal, many companies in the U.S. remove ultrafine coal by cyclone prior to flotation and subsequently dewater the froth product using screen-bowl centrifuges. A sample of cyclone overflow containing particles finer than 400 mesh (37 μm) and 53.6% ash was subjected to a series of selective agglomeration tests using n-pentane as agglomerant. The tests were conducted by varying oil dosages, agitation speed, and agitation time. As shown in Table 4, low-shear agitation resulted in high-ash and high-moisture products. Combination of high- and low-shear agitation gave better results. In general, selective oil agglomeration did an excellent job in ash rejection. However, product moistures were high due to the entrapment of water within the structure of the agglomerates as has already been discussed.

TABLE 4

| Product (% wt) | | Combustible | Oil Dosage | Agitation Speed & |
|---|---|---|---|---|
| Moisture | Ash | Recovery (% wt) | (% wt) | Time (min) |
| 61.2 | 19.1 | 74.1 | 25 | low shear (2) |
| 24.8 | 11.1 | 67.0 | 50 | high shear (0.5) & low shear (2) |
| 43.1 | 10.4 | 66.1 | 30 | high shear (0.5) & low shear (2) |
| 50.9 | 11.0 | 72.2 | 20 | high shear (0.5) & low shear (2) |
| 45.8 | 13.2 | 75.8 | 10 | high shear (0.5) & low shear (2) |

The same coal sample was subjected to a series of oil agglomeration tests as described above. The amount of n-pentane used in each test was 20% by weight of feed, and the mixture was agitated for 30 s at a high speed and then for 2 min at a low speed. The results presented in Table 5 show that the moistures of the clean coal products were substantially reduced further from those obtained in the agglomeration tests (Table 4). The improvements can be attributed to the liberation of the interstitial water by dispersing the agglomerates in a hydrophobic liquid. Note also that by releasing the interstitial water, the mineral matter dispersed in it was also removed, resulting in a further reduction in ash content beyond what was obtainable using the selective agglomeration process alone. Thus, the process of the instant invention can improve both moisture and ash rejections.

TABLE 5

| Product (% wt) | | Combustible |
|---|---|---|
| Moisture | Ash | Recovery (% wt) |
| 3.1 | 2.8 | 78.8 |
| 3.5 | 3.9 | 84.7 |
| 3.8 | 2.9 | 83.4 |
| 10.6 | 3.0 | 78.8 |
| 10.0 | 2.5 | 78.7 |
| 4.4 | 3.0 | 80.1 |
| 9.1 | 3.7 | 86.7 |

Example 7

A sample of screen bowl effluent was received from a metallurgical coal processing plant and used for the process of the present invention. The effluent, containing 11% ash, was processed at 5% solids as received without thickening. The procedure was the same as described in the preceding examples. The amount of n-pentane used was 20% by weight of feed, and the slurry was agitated for 20 s in a kitchen blender at a high agitation speed. The results presented in Table 6 show that low-moisture and low-ash products were obtained from the screen bowl effluent. Since the coal was very hydrophobic, it was not necessary to have a low-shear agitation after the high-shear agitation.

The fourth column of Table 6 gives the % solids of the coal dispersed in n-pentane. The data presented in the table show that product moistures become higher at higher % solids. However, other operating conditions such as the amount of mechanical energy used to break agglomerates and facilitate dispersion also affected the moisture. In this example, the mechanical energy was provided by a set of two vibrating meshes moving up and down in the pentane phase. The solid content in dispersed phase is important in continuous operation, as it affects throughput and product moisture.

TABLE 6

| Product (% wt) | | Reject Ash | % Solid | Combustible |
|---|---|---|---|---|
| Moisture | Ash | (% wt) | Pentane | Recovery % |
| 8.1 | 2.3 | 84.0 | 7.1 | 98.0 |
| 6.1 | 2.0 | 84.3 | 6.3 | 98.0 |
| 6.8 | 2.7 | 83.8 | 7.3 | 98.1 |
| 2.8 | 2.2 | 83.0 | 1.7 | 97.8 |

Example 8

A bituminous coal processing plant is cleaning a 100 mesh×0 coal assaying approximately 50% ash by flotation. Typically, clean coal products assay 9 to 11% ash. A coal sample was taken from the plant feed stream and subjected to the method of the present invention. As shown in Table 7, the process produced low-ash (3.2 to 4.2%) and low-moisture (~1%) products with approximately 90% combustible recoveries. Without the additional dispersion step, the agglomerates assayed 37.2 to 45.1% moistures.

TABLE 7

| Feed Ash | Product Moisture (% wt) | | Ash (% wt) | | Combustible Recovery |
|---|---|---|---|---|---|
| (% wt) | Agglomerate | Dispersed | Clean Coal | Reject | (%) |
| 51.0 | 45.1 | 1.1 | 4.2 | 90.0 | 88.9 |
| 52.6 | 45.2 | 0.7 | 3.5 | 91.4 | 89.9 |
| 52.6 | 37.2 | 1.0 | 3.6 | 91.7 | 90.3 |

Example 9

Two different bituminous coal samples were subjected to continuous process of the present invention. n-pentane was used as a hydrophobic liquid. The process was substantially the same as described in FIG. 2, except that an ultrasonic vibrator rather than a set of vibrating mesh was used to break the agglomerates and facilitate dispersion in n-pentane. As shown in Table 8, the oil agglomeration followed by a dispersion step reduced the ash content of a metallurgical coal from 51 to 3.6% ash with a 92% combustible recovery. With another coal sample assaying 40.4% ash, the ash contents were reduced to 3.3 to 5.0% with combustible recoveries in the neighborhood of 80%.

The bulk of the spent pentane was recycled without phase changes. However, a small amount of the hydrophobic liquid adhering onto coal surfaces was recycled by evaporation and condensation. The amount of n-pentane that was lost due to adsorption or incomplete removal from coal was in the range of 1.5 to 4 lb/ton of clean coal. The energy cost for evaporating n-pentane is substantially less than that for water in view of the large differences in boiling points (36.1° C. vs. 100° C.) and heats of vaporization (358 kJ/kg vs. 2,257 kJ/kg) for pentane and water.

TABLE 8

| Feed | Product (% wt) | | Reject | Combustible |
|---|---|---|---|---|
| Ash (% wt) | Moisture | Ash | Ash (% wt) | Recovery (% wt) |
| 51.0 | 2.9 | 3.6 | 92.6 | 92.0 |
| 40.4 | 1.0 | 5.0 | 80.6 | 84.8 |
| 40.4 | 3.8 | 3.3 | 80.1 | 83.9 |

Example 10

In this example, a subbituminous coal (−1.18+0.6 mm) from Wyoming was dry pulverized and hydrophobized in water using sorbitanmonooleate (Reagent U) in the presence of water. The coal sample assayed 28% moisture by weight of as-received moisture, 8.5% ash, and 8,398 Btu/lb. As shown in Table 9, the process of the present invention substantially reduced the moisture and hence increased the heating values. In general, the moisture reductions were higher at higher reagent dosages and longer agitation times. As has been the cases with bituminous coals, the hydrophobized subbituminous coal also formed agglomerates in the presence of a hydrophobic liquid (n-pentane) but the agglomerate moistures were high due to the entrapment mechanism discussed in the foregoing examples. When the agglomerates were dispersed in n-pentane, however, the moisture contents were substantially reduced and the heading values increased accordingly.

TABLE 9

| Reagent U | | Agglomerate | Product | | |
|---|---|---|---|---|---|
| Dosage (lb/ton) | Agtn. Time (min) | Moisture (% wt) | Moisture (% wt) | Ash (% wt) | Heating Value (Btu/lb) |
| 33.3 | 15 | 44.6 | 38.2 | 6.2 | 7,562 |
| 33.3 | 30 | 27.1 | 20.8 | 5.8 | 9,814 |
| 50 | 5 | 46.2 | 6.0 | 5.8 | 11,560 |
| 50 | 30 | 28.1 | 4.1 | 6.0 | 11,759 |

Example 11

In this example, a Wyoming coal sample was hydrophobized by esterification with ethanol and then subjected to the process of the present invention. The reaction took place at 50° C. in the presence of a small amount of $H^+$ ions as a catalyst. As has already been discussed, the esterification reaction removes the chemically bound water by condensation and renders the coal hydrophobic. The hydrophobized coal sample was then subjected to the process of the present invention (HHS) as discussed above to remove the water physically entrapped within the agglomerate structure and the capillaries of low-rank coals. As is well known, much of the 'inherent moistures' in low-rank coals is due to the water trapped in macropres (Katalambula and Gupta, Energy and Fuels, vol. 23, p. 3392, 2009).

The ethanol molecules may be small enough to penetrate the pore structures and remove the water by condensation and the displacement mechanisms involved in the process. A strong evidence for this possibility may be that even the coarse particles were readily dewatered as shown in Table 10. Also shown in that table is that the hydrophobized low-rank coals form agglomerates, which trap large amount of moistures. When they were dispersed in n-pentane, however, the moisture was substantially reduced.

TABLE 10

| Top Size of | Agglomerate | HHS Product | | |
|---|---|---|---|---|
| Coal Samples (mm) | Moisture (% wt) | Moisture (% wt) | Ash (% wt) | Heating Value (Btu/lb) |
| 0.350 | 40.3 | 3.20 | 9.92 | 10,827 |
| 0.600 | 25.62 | 3.20 | 9.82 | 11,019 |
| 1.180 | 28.34 | 2.87 | 8.4 | 11,216 |
| 6.300 | 37.63 | 2.30 | 6.27 | 11,529 |

Table 11 shows the results obtained with different alcohols for esterification. As shown, the shorter the hydrocarbon chains of the alcohols, the lower the moistures of the Wyoming coal samples treated by the HHS process. This Finding suggests that smaller molecules can more readily enter the pores and remove the chemically-bound water by the mechanisms discussed above.

TABLE 11

| | Agglomerate | HHS Product | | |
|---|---|---|---|---|
| Alcohol | Moisture (% wt) | Moisture (% wt) | Ash (% wt) | Heating Value (Btu/lb) |
| Methanol | 25.39 | 8.32 | 2.35 | 11,625 |
| Ethanol | 30.92 | 9.14 | 3.20 | 11,125 |
| 2-Propanol | 29.82 | 10.12 | 0.93 | 10,693 |
| 1-Pentanol | 31.05 | 15.12 | 3.8 | 10,092 |

Although certain presently preferred embodiments of the invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

What is claimed is:

1. A process of upgrading a low-rank coal comprising the steps of a. heating said low-rank coal in a hydrothermal reactor in the presence of $CO_2$, b. displacing water released during the hydrothermal process with liquid $CO_2$, and c. transporting the dewatered coal under a $CO_2$ atmosphere, thereby minimizing the possibility of spontaneous combustion.

2. A process for removing water entrapped in a filter cake of hydrophobic particles comprising:

placing the filter cake in a hydrophobic liquid such that the hydrophobic particles are dispersed in the hydrophobic liquid to separate the entrapped water along with hydrophilic particles present in the water from the hydrophobic particles.

3. The process of claim 2, wherein the hydrophobic liquid is separated from the dispersed hydrophobic particles.

* * * * *